United States Patent [19]

Zylbert

[11] Patent Number: 4,598,753

[45] Date of Patent: Jul. 8, 1986

[54] METHOD FOR PRESSING FINLESS SEWING MACHINE NEEDLES

[75] Inventor: Thaddeus J. Zylbert, Morris Plains, N.J.

[73] Assignee: The Singer Company, Stamford, Conn.

[21] Appl. No.: 658,726

[22] Filed: Oct. 9, 1984

[51] Int. Cl.[4] ..... B21G 1/04

[52] U.S. Cl. ..... 163/5

[58] Field of Search ..... 163/1-5; 72/377; 112/222, 182

[56] References Cited

U.S. PATENT DOCUMENTS 4,044,814 8/1977 Zocher ..... 163/5

*Primary Examiner*—Mark Rosenbaum

*Attorney, Agent, or Firm*—Robert E. Smith; David L. Davis; Edward L. Bell

[57] ABSTRACT

A method is disclosed for finlessly pressing sewing machine needles without compromising any predetermined final needle configuration by operating on the needle blank prior to any deformation by pressing step to form in the blank a varying cross-sectional area along its length matching the finished needle cross-sectional area.

4 Claims, 11 Drawing Figures

PRIOR ART
Fig.1
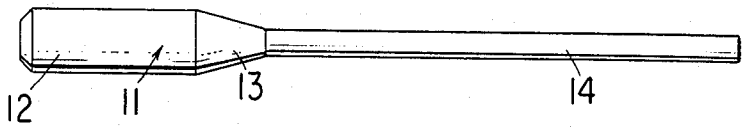
Fig.2
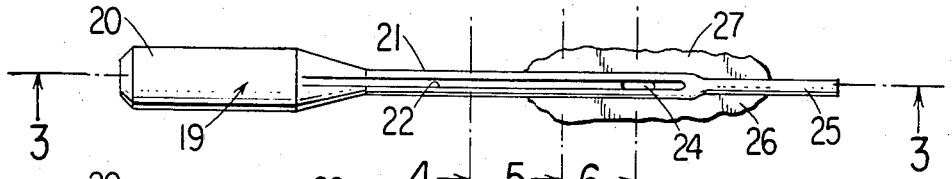
Fig.3
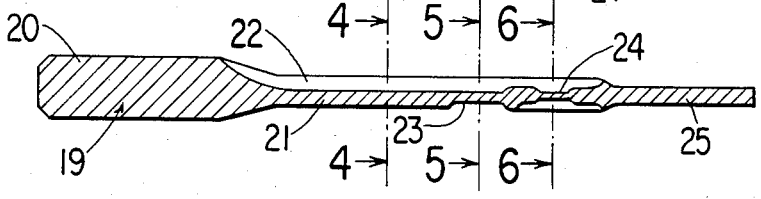
Fig.4
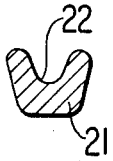
Fig.5
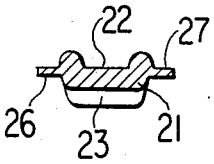
Fig.6
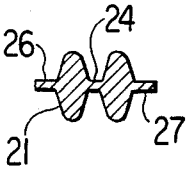
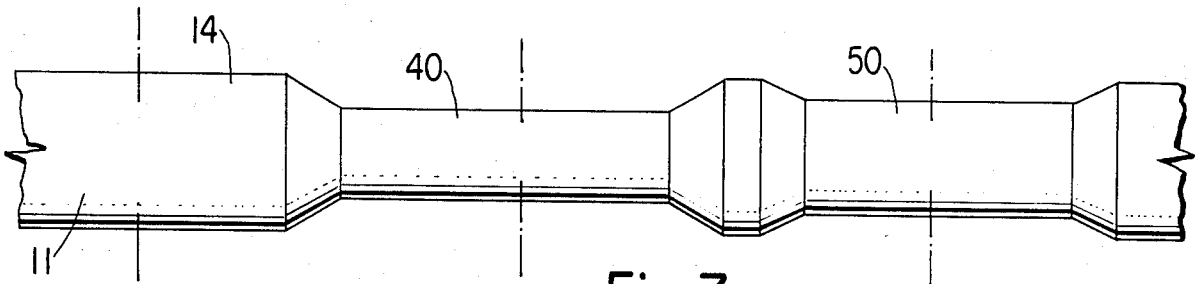
Fig.7
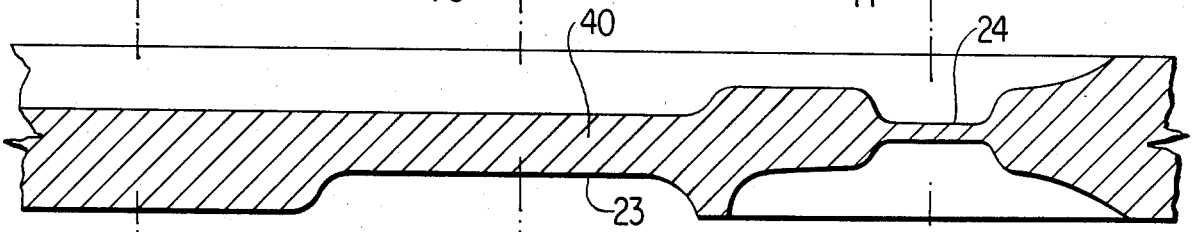
Fig.8
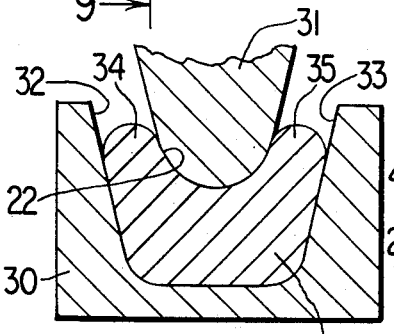
Fig.9
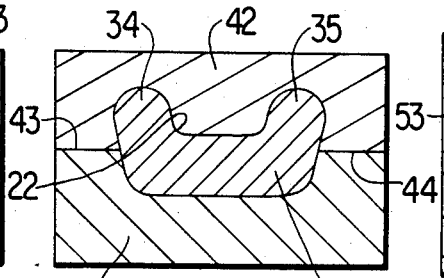
Fig.10
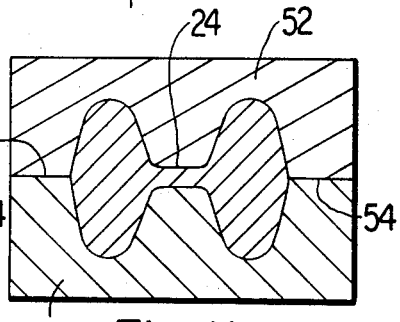
Fig.11

METHOD FOR PRESSING FINLESS SEWING MACHINE NEEDLES

DESCRIPTION

1. Field of the Invention

This invention relates to the manufacture of sewing machine needles and, more particularly, to a novel and advantageous method for finlessly pressing sewing machine needles of any predetermined configuration.

2. Description of the Prior Art

U.S. Pat. No. 4,037,641, July 26, 1977, discloses a known method for the manufacture of sewing machine needles in which a needle blank is deformed by pressing techniques. In the formation of the needle blade portion in accordance with this prior patent a needle blank is prepared with a stem portion of uniform cross-sectional shape and uniform cross-sectional area from which stem portion the needle blade shape is influenced by a sequence of deformation by pressing steps.

A factor militating against uniformity of final needle configuration where deformation by pressing technique is used, however, arises when an unwanted protuberance such as a fin is formed incident to the pressing technique as clearly shown in U.S. Pat. No. 4,037,641. Such protuberance or fin must be removed by a grinding or cutting step at or near the very conclusion of the needle fabrication process. In such a case the near final cutting or grinding step of fin or protuberance removal exposes the needles to the possibility of the very variations which the pressing techniques is potentially advantageous in obviating.

One way of eliminating or minimizing the formation of an unwanted protuberance in needles fabricated using deformation by pressing technique is to purposely compromise the final needle configuration so as to accommodate the material which would otherwise form the protuberance or fin. The U.S. Pat. No. 4,458,614, July 10, 1984, provides an example of such accommodation in its disclosure of a needle having a clearance above the eye provided by a cranked offset without reduction of the blade cross-sectional area as compared with the remainder of the blade above the needle eye. Such a cranked needle configuration, however, may not have universal application in that it may leave unsightly needle holes in certain delicate work fabrics and it may not cooperate satisfactorily with various types of needle guards and needle camming devices.

SUMMARY OF THE INVENTION

It is an object of this invention to provide a method for producing needles using deformation by pressing techniques free of unwanted protuberances or fins and without compromising any predetermined final needle configuration.

The advantages of attainment of the object of this invention is that a cutting or grinding step for fin removal at or near the conclusion of needle fabrication is eliminated resulting in increased uniformity of needle configuration.

This object of the invention is attained by operating on the needle blank prior to any deformation by pressing step to form the blank by swaging, grinding or cutting to a varying cross-sectional area along its length matching the varying cross-sectional area along the length of the finished needle.

The cutting or grinding step may be executed with far greater control and precision on a blank of circular cross-section than upon a formed needle with diverse cross-sectional shape. Furthermore, the effect of slight variation in needle blank configuration will be spread generally over an area of the finished needle while variations introduced at or near the completion of needle fabrication are more apt to be localized.

DESCRIPTION OF THE DRAWINGS

FIG. 1 is an elevational view of a needle blank swaged in accordance with the prior art, FIG. 2 is an elevational view of a sewing machine needle after completion of deformation by a known pressing technique from a needle blank as illustrated in FIG. 1, FIG. 3 is a lengthwise cross-sectional view of the sewing machine needle taken along line 3—3 of FIG. 2, FIGS. 4, 5 and 6 are enlarged cross-sectional views of the needle taken, respectively, along lines 4—4, 5—5 and 6—6 of FIGS. 2 and 3, FIG. 7 is an enlarged elevational view of a portion of the swaged stem of the needle blank of FIG. 1 showing additional blank shaping operations in accordance with this invention, FIG. 8 is an enlarged cross-sectional view of portions of a needle blade of the same style shown in FIG. 3 but fabricated using deformation by pressing techniques from the needle blank of FIG. 7 showing the various portions of the needle blade arranged laterally opposite the segments of needle blank of FIG. 7 from which it is formed, and FIGS. 9, 10 and 11 are cross-sectional views of the needle taken, respectively, along lines 9—9, 10—10 and 11—11 of FIGS. 7 and 8 together with cross-sectional representation of the die elements used to form these portions of the needle blade.

BRIEF DESCRIPTION

Referring to the drawings, FIG. 1 illustrates a metal blank 11 conventionally formed as the initial step in fabrication of a sewing machine needle. Typically, the blank 11 is formed by a cylindrical element initially having a uniform diameter of the portion 12 of which one extremity is drawn out preferably by a rotary swaging operation to form a tapered neck portion 13 and a stem portion 14 of uniform diameter smaller than the diameter of the portion 12.

FIGS. 2 and 3 represent the cross-sectional and elevational configuration, respectively, of a well known type of sewing machine needle 19 produced by using deformation by pressing technique and finished except for eye punching, pointing and fin removal. In FIGS. 2 and 3, 20 represents the needle butt, 21 the needle blade, 22 the long thread accommodating groove, 23 the scarfed recess referred to as clearance above the eye (CAE), 24 the thin web which when punched out provides the thread carrying needle eye, and 25 the point portion of the needle.

As illustrated in FIGS. 4, 5 and 6, which show the transverse cross-sectional configurations of the needle blade above the CAE in FIG. 4, in the CAE in FIG. 5, and at the eye in FIG. 6, respectively, the cross-sectional area at each of these points along the needle blade differs, the CAE being appreciably smaller in cross-sectional area than the blade above the CAE, and the eye portion being only slightly smaller in cross-sectional area.

Assuming that the diameter of the stem portion 14 of the prior art blank was chosen to provide the desired form of the largest segment of the needle blade as shown in FIG. 4, fins 26 and 27 will inevitably be formed one at each side of the CAE and eye portions of the needle as shown in FIGS. 2, 5 and 6.

Two types of pressing techniques are known for use in shaping sewing machine needles; the first, which is referred to as flow pressing, provides space within the die cavity for unrestricted lateral deformation of the metal being operated upon; the second, which is referred to as die pressing, provides for complete closure of a die cavity which, therefore, is of predetermined cross-sectional configuration when closed.

A fin cannot be formed along those segments of a needle fabricated by flow pressing techniques, however, excess material in the blank can give rise to undesirable protuberance into the die spaces in which unrestricted deformation is possible. When die pressing techniques are utilized, excess material in the blank will result in formation of fins along the parting lines of the die segments. Such fins, in addition to requiring additional steps for removal, can adversely interfere with the closure of the die segments and can thus modify the predetermined cross-sectional configuration influenced by the dies.

FIG. 7 illustrates a part of the stem portion of the needle blank 11 which, in accordance with this invention, is prepared prior to deformation by pressing technique with variation in diameter of selected segments along its length such that the cross-sectional area at each point along its length is substantially equal to the cross-sectional area of the finished needle at the corresponding point. As illustrated, the cross-sectional area is modified by the physical removal of material from the blank. While such removal of material may be accomplished by any cutting, swaging or grinding operation, a preferred mode is by a grinding operation during rotation of the blank. By this mode the cylindrical form of the blank is maintained which provides for a high level of accuracy in the selective removal of metal from the blank without imposing distributional problems incident to subsequent deformation of the metal by pressing.

As explained above, the stem portion 14 of the needle blank as formed in the metal blank preparation stage illustrated in FIG. 1 is preferrably chosen in dimension so as to serve for the major portion of the needle blade 21. A preferable method for the formation of the needle blade configuration on section line 9—9 is by flow pressing between a base die 30 and a groove forming die 31. It will be noted in FIG. 9 that the flow pressing die set does not close but rather it provides for unrestricted flow of the metal in spaced channels 32 and 33 which define in the needle blade 21 the flanges 34 and 35 bordering the thread accommodating groove 22.

FIG. 10 illustrates the formation of the needle blade shape along that segment of the needle blade which is scarfed as at 23 to provide the clearance above the eye (CAE). Since the cross-sectional area along the CAE is less than that of the finished needle blade above the CAE, a section 40 of the blank stem 14 is formed with correspondingly reduced cross-sectional area and as a result, when subsequently the CAE segment is formed by die pressing between a set of dies 41 and 42 which close along parting lines 43 and 44, the absence of excess metal in the needle blank along this segment obviates the formation of a fin and permits the die set 41 and 42 to close completely to establish the predetermined shape of the needle blank in the CAE segment.

Similarly, a somewhat less reduced cross-sectional area segment 50 of the stem portion of the needle blank is formed over that length which is subsequently die pressed by the die set 51 and 52 to form the eye portion of the finished needle. As with the CAE portion, proper control of the cross-sectional area of the segment 50 in the blank prior to deformation by pressing eliminates the formation of exterior fins along the parting lines 53 and 54 of the die set 51 and 52.

After preparing the stem portion 14 of the needle blank with varying cross-sectional area to match that of the predetermined finished needle configuration it is necessary to orient the prepared needle blank lengthwise with respect to the dies for accomplishing the deformation so that an appropriate blank segment is arranged in each location along the dies.

Subsequent operation of the dies either sequentially or simultanously will then produce a finished finless configuration of the needle except for punching the needle eye and tapering the point. Any known eye punching and point grinding operation will then completely finish the needle shaping operation. Since neither eye punching or point grinding have any appreciable adverse effect on the configuration of the remainder of the needle blade, the shape imparted by die forming in the method of this invention will be substantially unaffected by any subsequent finishing steps so that great uniformity and predictability of needle configuration is attainable with this invention.

I claim:

1. The method of fabricating a sewing machine needle having a butt portion, a blade extending from said butt portion, a needle eye extending through said blade, a tapered point adajcent said needle eye, and a clearance above the eye defined by a recess in one side of said blade between the eye and the butt portion comprising the steps of:

preparing a cylindrical blank with varying cross-sectional area along its length, providing shaped dies for pressing said needle blank into the finished shape of the needle, orienting the prepared blank lengthwise relatively to said shaped dies, subjecting the needle blank to deformation by pressing with said shaped dies finlessly into the finished shape of the needle with exception of the needle eye and the tapered point, said cross-sectional area of said cylindrical blank being sized along its length so that there is an absence of excess metal upon deformation of said needle blank into said finished shape to obviate the formation of a fin, punching the needle eye, and grinding only that portion of said needle blade adjacent to said eye to form said tapered point.

2. The method of fabricating a sewing machine needle as set forth in claim 1 in which said cylindrical blank is prepared by first swaging a portion of the blank into reduced cylindrical cross-sectional shape of uniform diameter, and subsequently introducing variation in the cross-sectional area of selected points along said blank by physically removing selected amounts of material from said blank.

3. The method of fabricating a sewing machine needle as set forth in claim 2 in which variation in the cross-sectional area of selected locations along said blank is accomplished by grinding the surface of the blank while the blank is being rotated so as to retain the cylindrical shape of the blank.

4. The method of fabricating a sewing machine needle having a butt portion, a blade extending from said butt portion, a needle eye extending through said blade, a tapered point adjacent said needle eye, and a clearance above the eye defined by a recess in one side of said blade between the eye and the butt portion comprising the steps of:

preparing a cylindrical blank with varying cross-sectional area along its length, providing shaped dies for die pressing those portions of said needle blank accommodating the needle eye and the clearance above the eye and for pressing the remainder of said needle blank, orienting the prepared blank lengthwise relatively to said shaped dies, subjecting the needle blank to deformation by pressing with said shaped dies finlessly into the finished shape of the needle with exception of the needle eye and the tapered point, said cross-sectional area of said cylindrical blank being sized along its length so that there is an absence of excess metal upon deformation of said needle blank into said finished shape to obviate the formation of a fin, punching the needle eye, and grinding only that portion of said needle blade adjacent to said eye to form said tapered point.

* * * * *